US005139254A

United States Patent [19]

Yamashita et al.

[11] Patent Number: 5,139,254

[45] Date of Patent: Aug. 18, 1992

[54] SHEET STORING APPARATUS

[75] Inventors: Hiroki Yamashita, Okazaki; Kiyoshi Emori, Toyokawa, both of Japan

[73] Assignee: Minolta Camera Kabushiki Kaisha, Osaka, Japan

[21] Appl. No.: 670,897

[22] Filed: Mar. 18, 1991

[30] Foreign Application Priority Data

Mar. 20, 1990 [JP] Japan ..... 2-71586
Mar. 20, 1990 [JP] Japan ..... 2-71587
Mar. 20, 1990 [JP] Japan ..... 2-71588

[51] Int. Cl.[5] ..... B65H 43/04

[52] U.S. Cl. ..... 271/215; 271/213; 271/217; 271/902

[58] Field of Search ..... 271/213, 215, 217, 902, 271/245, 314

[56] References Cited

U.S. PATENT DOCUMENTS 3,682,328 8/1972 Turner et al. ..... 214/6 H
4,718,657 1/1988 Otter et al. ..... 271/184
4,927,131 5/1990 Hashimoto et al. ..... 271/217
4,955,597 9/1990 Johdai et al. ..... 271/215
4,959,685 9/1990 Kato ..... 355/72

FOREIGN PATENT DOCUMENTS 61-206769 9/1986 Japan .

*Primary Examiner*—H. Grant Skaggs
*Attorney, Agent, or Firm*—Burns, Doane, Swecker & Mathis

[57] ABSTRACT

Disclosed is a sheet storing apparatus with a sheet tray which is movable up and down. When the tray moves down to a position which is specified according to the sheet size, fullness of the sheet tray is judged. The sheet storing apparatus has a sheet sensor for detecting a sheet on the tray and a top surface sensor for detecting the upper surface of the tray on which sheets are to be stacked or the top surface of a sheet stack on the tray being at a specified position. A specified time after the sheet sensor detects no sheets, the tray starts moving up, and the upward movement of the tray is stopped when the top surface sensor generates a detection signal. The sheet storing apparatus further has a paddle wheel for aligning sheets transported onto the tray. A specified time after the top surface sensor generates a detection signal in a situation that the sheet sensor detects a sheet, the tray starts moving down.

21 Claims, 8 Drawing Sheets 1
2
10
11
12
13
14
15
16
17
21
22
23
24
25
26
27
28
30
31
32
33
35
36
37
40
50
51
52
53
54
55
56
57
58
60
61
62
63
64
65
66
67
70
70a
71
71a
73
73a
74
74a
75
75a
76
76a
77
77a
SE1
SE1a
SE2
SE2a
SE3
SE3a
SE4
SE4a
SE5
SE5a
SE11
SE12
SE13
SE14
P
Q

SHEET STORING APPARATUS

BACKGROUND OF THE INVENTION

1. Field of the Invention

The present invention relates to a sheet storing apparatus, and more particularly to a sheet storing apparatus for stacking sheets ejected from an image forming apparatus such as an electrophotographic copying machine or a laser printer on a tray.

2. Description of Related Art

In a laser printer, a large number of sheets are used in a printing operation, and therefore various sheet storing apparatuses having a capacious stacking table such as a tray or a stacker have been provided for laser printers. Generally, such a sheet storing apparatus is so made that the stacking table moves downward intermittently as a sheet stack thereon is growing, and therefore the sheet storing apparatus is capacious. Incidentally, sheets are different in weight, depending on the size, and a stack of a larger size of sheets is heavier than that of a smaller size of sheets when they are the same height. A limit is set to the height of a sheet stack to be placed on a stacking table, and generally the height limit is determined depending on how high the largest size of sheets can be stacked on the stacking table without damaging the stacking table, its supporting means and driving means. In stacking a smaller size of sheets on the thus designed stacking table, the stack comes to the height limit although the stacking table is strong enough to receive more sheets.

U.S. Pat. No. 4,927,131 discloses that a limited number of sheets can be stacked on a stacking table and that the limit is varied in accordance with the size of sheets. According to U.S. Pat. No. 4,927,131, different limits are predetermined from size to size, and sheets stacked on the stacking table are counted. However, this system does not comply with a case where some sheets are taken out of the stack during a counting operation, and the count value becomes different from the actual number of sheets on the stacking table.

The reason why the stacking table is moved down with growth of a sheet stack thereon is to keep a certain distance between a nipping portion of rollers for ejecting sheets from the image forming apparatus onto the stacking table and the top surface of the sheet stack on the stacking table. Thereby the sheets on the stacking table can be maintained in alignment. The device disclosed in U.S. Pat. No. 4,927,131 has a sensor for detecting a sheet on a tray and a sensor for detecting the top surface of a sheet stack on the tray. In the device, it is judged from the outcome of the top surface sensor that some sheets are taken out of the tray, and in this case the tray is moved up.

However, in this type of device, the tray is not always moved up in response to a decrease of a sheet stack on the tray. When an operator lifts up the leading ends (in the sheet storing direction) of the sheets so as to discharge the sheets from the tray, the sheet sensor detects no sheets on the tray, while the top surface sensor detects the sheets lifted by the operator and judges that there is no space for more sheets on the tray. In this case, the tray is not moved up when the operator finishes discharging the sheets from the tray.

In this type of device, when the top surface sensor detects the top surface of a sheet stack on the tray, the tray is moved down immediately. By this downward movement, the distance between the nipping portion of the ejection rollers and the top surface of the sheet stack on the tray is so elongated that the next transported sheet may not be aligned on the tray. Especially in a device wherein a paddle wheel is disposed coaxially with the ejection rollers so as to align a sheet being transported from the ejection rollers onto the tray, immediately after the tray is moved down, the blades of the paddle wheel cannot reach the sheet transported onto the tray, and the sheet cannot be aligned.

SUMMARY OF THE INVENTION

An object of the present invention is to provide a sheet storing apparatus wherein the height limit of a sheet stack is automatically altered in accordance with the size of sheets, and fullness of the sheet storing apparatus can be certainly detected.

Another object of the present invention is to provide a sheet storing apparatus wherein a tray moves up to a home position when the tray is emptied of sheets without respect to the operator's manner of discharging the sheets from the tray.

Further, another object of the present invention is to provide a sheet storing apparatus wherein sheets on a tray are certainly aligned even immediately after the tray moves down with growth of the sheet stack on the tray.

In order to attain the objects above, a sheet storing apparatus according to the present invention comprises means for stacking sheets transported thereto; drive means for moving up and down the sheet stacking means; control means for controlling the drive means to move down the sheet stacking means as a sheet stack on the sheet stacking means is growing; and means for judging fullness of the sheet stacking means when the sheet stacking means is moved down to a position which is specified according to the size of stacked sheets.

Information on the sheet size is sent from an image forming apparatus such as a copying machine or a printer to which the sheet storing apparatus is attached, and the sheet size is entered in a control section on the sheet storing apparatus. When the sheet stacking means is moved down to a position specified according to the sheet size, the sheet stacking means is judged to be full oi sheets and the downward movement of the sheet stacking means is stopped. The sheet stacking means is moved down farther when loaded with small and light sheets than when loaded with large and heavy sheets. According to the present invention, the height limit of a sheet stack on the sheet stacking means can be altered according to the sheet size, and the sheet stacking means can receive more sheets when the sheets are smaller and lighter. Thus, the downward movement of the sheet stacking means is controlled in accordance with the actual volume (height) of the sheet stack, and fullness of the sheet stacking means can be judged correctly.

A sheet storing apparatus according to the present invention further comprises means for detecting a sheet on the sheet stacking means; means for detecting the surface of the sheet stacking means on which sheets are to be stacked or the top surface of a sheet stack on the sheet stacking means being at a specified position; and control means for controlling the drive means to start moving up the sheet stacking means a specified time after the sheet detecting means detects no sheets and to stop the upward movement of the sheet stacking means when the top surface detecting means generates a detection signal.

In order to discharge sheets from the sheet stacking means, an operator generally lifts up the sheets. In this situation, the sheet detecting means detects no sheets, and the top surface detecting means may detect the sheets and generate a detection signal. If the sheet stacking means was so made to move up simultaneously with detection of no sheets by the sheet detecting means, the sheet stacking means would be stopped from moving up when the top surface detecting means detects the sheets lifted by the operator. That is, the sheet stacking means would not be moved up. According to the present invention, however, the sheet stacking means is kept from moving up for the specified time after the sheet detecting means detected no sheets. A detection signal generated from the top surface detecting means within the specified time has no connection with movement of the sheet stacking means. The specified time should be a time within which the operator can complete discharging the sheets from the sheet stacking means. Generally, in discharging the sheets from the sheet stacking means, an operator lifts up the sheets for one to two seconds. Accordingly, in most cases the specified time is one second. This control procedure ensures the upward movement of the sheet stacking means.

A sheet storing apparatus according to the present invention comprises not only sheet stacking means, drive means and sheet detecting means as described above, but also means for aligning sheets transported to the sheet stacking means, and control means for controlling the drive means to start moving down the sheet stacking means a specified time after the top surface generates a detection signal in a situation that the sheet detecting means detects a sheet. In this apparatus, the sheet stacking means is kept from moving down for the specified time after the top surface detecting means generated a detection signal. Within the specified time, some sheets are transported to the sheet stacking means, and the sheet stack becomes high enough that the aligning means can touch the sheet stack on the top surface when the sheet stacking means is moved down. Thereby, sheets can be aligned by the aligning means even immediately after a downward movement of the sheet stacking means. The specified time should be determined according to the thickness of sheets, the interval between sheets transported to the sheet stacking means, etc. This control procedure ensures the alignment of sheets on the sheet stacking means.

BRIEF DESCRIPTION OF THE DRAWINGS

These and other objects and features of the present invention will become apparent from the following description taken in conjunction with the preferred embodiments thereof in reference to the accompanying drawings, in which.

DETAILED DESCRIPTION OF THE PREFERRED EMBODIMENTS

Figure 1:
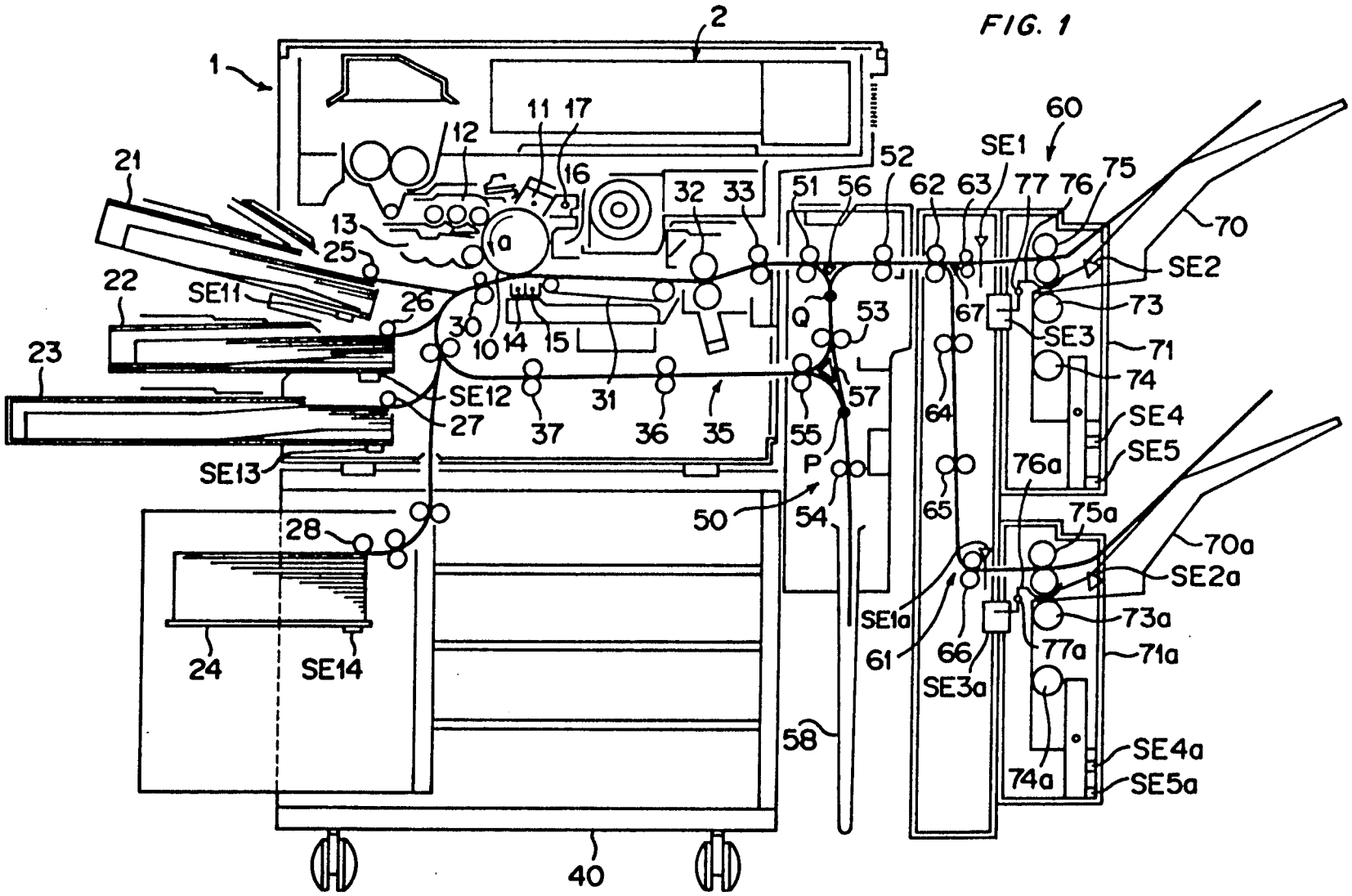
FIG. 1 is a schematic view of a printer equipped with a sheet storing unit according to the present invention.

The following describes a preferred embodiment of the present invention referring to the drawings.

FIG. 1 shows a laser printer which essentially consists of a body 1, a sheet storing unit 60 according to the present invention and a sheet reversing unit 50.

The body 1 is mounted on a desk 40. In the body 1, a photosensitive drum 10 is disposed in the center in a manner to rotate in a direction indicated by the arrow (a). Around the photosensitive drum 10, there are disposed an electric charger 11, developing devices 12 and 13 adopting a magnetic brush method, a transfer charger 14, a sheet separation charger 15, a cleaning device 16 for removing residual toner, an eraser lamp 17 for erasing residual electrostatic, etc. An image is formed with a laser beam optical system 2 on the photosensitive drum 10 which has been subjected to a charging process. Since a printing operation using these elements are well known, we omit a description of the operation.

Automatic sheet feeding cassettes 21, 22 and 23 are disposed in three stories to the left of the printer body 1. Also, an elevating automatic sheet feeding unit 24, which can be optionally installed in the laser printer, is arranged in the desk 40. Sensors SE11, SE12, SE13 aad SE14 are disposed around the cassettes 21, 22 and 23, and the sheet feeding unit 24 respectively so as to detect the size of sheets in each cassette or unit. A sheet source is selected from the cassettes 21, 22 and 23, and the sheet feeding unit 24, and sheets are supplied from the selected cassette or unit one by one through a feeding roller 25, 26, 27 or 28. The solid lines in FIG. 1 indicate sheet paths. A sheet fed from the selected cassette or unit is once registered by timing rollers 30, and the sheet is fed into the image transfer station in synchronization with an image formed on the photosensitive drum 10. After an image has been transferred onto the sheet, the sheet is conveyed to a fixing device 32, where the image is fixed on the sheet by heat, through a conveyer belt 31. Then, the sheet is ejected from the printer body 1 through ejection rollers 33 and fed to the sheet reversing unit 50.

The sheet reversing unit 50 guides the sheet into a sheet refeed path 35 leading back to the printer body 1 so that the sheet will receive another image on the other side (duplex printing mode) or on the same side (composite printing mode), or guides the sheet into the sheet storing unit with the printed side facing up (non-reversing mode) or with the printed side facing down (reversing mode).

In order to perform the functions, the sheet reversing unit 50 comprises receiving rollers 51, ejection rollers 52, reversible rollers 53 and 54, refeed rollers 55, diverters 56 and 57, and a switchback path 58. The diverters 56 and 57 are driven by solenoids (not shown) so as to move between two positions.

In the non-reversing mode, the sheet is received by the rollers 51 and guided by the upper surface of the diverter 56. Then, the sheet passes through the ejection rollers 52 and is fed to the sheet storing unit 60 with the printed side facing up. In the reversing mode, the sheet received by the rollers 51 is guided by the left surface of the diverter 56. The sheet is transported downward by the forward rotation of the rollers 53 and is guided by the right surface of the diverter 57. The sheet is further transported by the forward rotation of the rollers 54 so that the leading end of the sheet enters the switchback path 58. When the trailing edge of the sheet comes to a point (Q), the rollers 53 and 54 are reversed so as to reverse the travel of the sheet. Then, the sheet is guided by the right surface of the diverter 56 and fed to the sheet storing unit 60 with the printed side facing down through the ejection rollers 52.

In the duplex printing mode, the sheet is guided to the switchback path 58 in the same manner as in the reversing mode, and when the trailing edge of the sheet comes to a point (P), the rollers 54 are reversed so as to reverse the travel of the sheet. The sheet is guided by the left lower surface of the diverter 57 and fed into the sheet refeed path 35 through the refeed rollers 55. In the composite printing mode, the sheet received by the rollers 51 is guided by the left surface of the diverter 56 to the rollers 53. Then, the sheet is guided by the left upper surface of the diverter 57 and fed into the sheet refeed path 35 through the refeed rollers 55.

The sheet storing unit 60 essentially consists of trays 70 and 70*a* in two stories, and a sheet transporting section 61. The trays 70 and 70*a* are movable horizontally in a direction perpendicular to the sheet ejecting direction and movable vertically in accordance with the volume of a sheet stack thereon.

The sheet transporting section 61 is formed of rollers 62, 63, 64, 65 and 66, and a diverter 67 disposed between the rollers 62 and 63. The diverter 67 is driven by a solenoid (not shown) so as to move between two positions. The diverter 67 guides a sheet to the rollers 63 and the upper tray 70 by using its upper surface, and guides a sheet downward to the rollers 64, 65 and 66, and the lower tray 70*a* by using its left surface. Sensors SE1 and SE1*a* are disposed immediately past the rollers 63 and 66 respectively.

The trays 70 and 70*a* are protruded from boxes 71 and 71*a* respectively. The trays 70 and 70*a* are movable horizontally in a direction perpendicular to the sheet ejecting direction and are movable vertically. Horizontal motors 73 and 73*a*, and vertical motors 74 and 74*a* are disposed under the respective tray 70 and 70*a*, and the horizontal and the vertical movements of the trays 70 and 70*a* are performed by a horizontal movement mechanism (not shown) and a vertical movement mechanism (not shown) respectively.

Since the trays 70 and 70*a* and their peripheral parts have the same constitution, the following describes only the upper tray 70. In the drawings, a numeral with "a" indicates a part related to the lower tray 70*a*.

Figure 2:
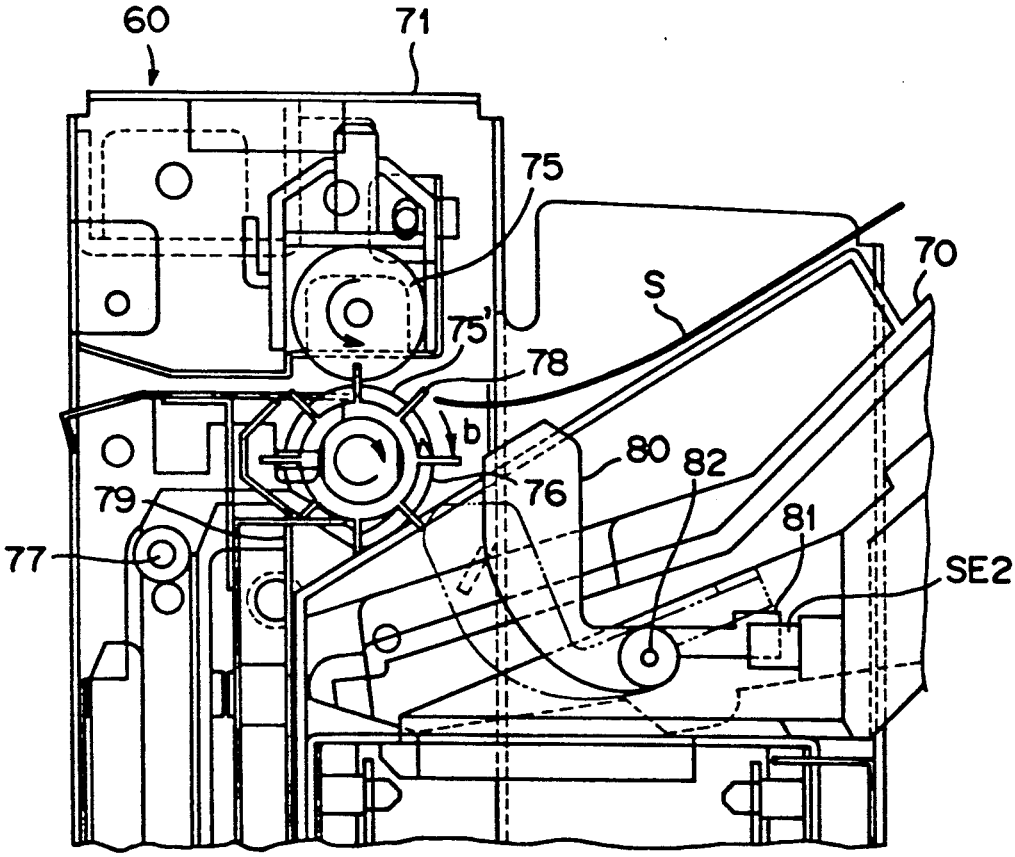
FIG. 2 is a view of the sheet storing unit showing its internal constitution.

Vertically coupled ejection rollers 75 are provided in the box 71 so as to transport the sheet fed from the sheet transporting section 61 onto the tray 70. Referring to FIG. 2, paddle wheels 78 are disposed coaxially with lower rollers 75' of the ejection roller pairs 75, and the lower rollers 75' and the paddle wheels 78 rotate together. The paddle wheels 78 provide a sheet S being ejected onto the tray 70 with force opposing the force ejecting the sheet S, on the trailing end. Thereby the sheet S is aligned on the tray 70. Specifically, as the paddle wheels 78 rotate in the direction of arrow (b), the blades of the paddle wheels 78, which are elastic, come to contact with the trailing end of the sheet S which passed through the ejection roller pairs 75 and fell on the tray 70. Thus, the sheet S is provided with force in the opposite direction to the force provided by the ejection roller pairs 75. The trailing edge of the sheet S is stopped and regulated by a rear plate 79 disposed at the rear of the tray 70. The tray 70 is provided with a sensor SE2 for detecting the sheet S on the tray 70. The SE2 cooperates with an actuator 80 protruding one end on the tray 70, and when the actuator 80 is pushed counterclockwise (comes to a position indicated by the two-dot and a chain line in FIG. 2) by the sheet S, the other end 81 of the actuator 80 retreats from the optical axis of the sensor SE2. On the other hand, when the sheet S is taken out of the tray 70, the actuator 80 returns to a position indicated by the solid line, and the end 81 comes into the optical axis of the sensor SE2.

A sensor SE3 for detecting the surface of the tray 70 or the top surface of a sheet stack on the tray 70, and an actuator 76 are provided so as to maintain the tray 70 in an appropriate position. The appropriate position of the tray 70 means a position where a sheet transported onto the tray 70 can be provided with the force by the paddle wheels 78 effectively and placed on the tray 70 in alignment. Practically, whether or not the tray 70 is in an appropriate position is judged from the distance between the nipping portion of the ejection roller pairs 75 and the surface of the tray 70 or the top surface of the sheet stack on the tray 70. The appropriate position has a certain range, and the sensor SE3 is to detect that the tray 70 comes to the upper limit of the appropriate position. The actuator 76 is capable of pivoting on a pin 77, and is extended onto the rear of the tray 76 along the lower ejection rollers 75'. The actuator 76 is capable of advancing into and retreating from the optical axis of the sensor SE3. The actuator 76 is usually urged clockwise on the pin 77 by a spring (not shown) and in a position indicated by the solid line in FIGS. 1 and 2, in which state, the sensor SE3 is off. Sheets are fed onto the tray 70 one by one and stacked thereon, and when the top surface of the sheet stack comes to the upper limit of the appropriate position, the actuator 76 is pushed counterclockwise by the topmost sheet, whereby the sensor SE3 is turned on. In response to the on-signal ±rom the sensor SE3, the vertical motor 74 is rotated to move down the tray 70. As the tray 70 moves down, the actuator 76 turns clockwise toward the initial position, whereby the sensor SE3 is turned off. The motor 74 is rotated for a specified period. Thus, when the top surface of the sheet stack on the tray 70 comes to the upper limit, the tray 70 is moved down by one step, a specified amount. A procedure of performing this downward movement of the tray 70 will be described in detail later referring to a flowchart.

Sensors SE4 and SE5 are disposed in the lower part of the box 71, and fullness of the tray 70 is judged when the sensor SE4 or SE5 detects the tray 70. When sheets of a large size are ejected from the printer body 1 and received on the tray 70, the upper sensor 8E4 is used, and when sheets of a small size are received on the tray 70, the lower sensor SE5 is used. Which sensor SE4 o SE5 is to be used is determined according to a sheet size signal sent from one of the sensors SE11 through SE14 provided in the sheet feeding section. A procedure of judging fullness of the tray 70 will be described in detail later referring to a flowchart.

When the tray 70 is emptied of sheets, the sensor SE2 is turned off, in response to which the vertical motor 74 is rotated to move up the tray 70. The motor 74 is rotated until the tray 70 returns to the initial position, that is, until the sensor SE3 is turned on. In this embodiment, the motor 74 is turned on to move up the trap 70, three seconds after the sensor SE2 is turned off. A procedure of performing this upward movement of the tray 70 will be described in detail later referring to a flowchart.

Meanwhile, every time a set of information is printed out on sheets, the horizontal motor 73 is rotated for a specified period so as to move the tray 70 in a direction perpendicular to the travel of sheets, whereby the sheets are sorted.

Figure 3:
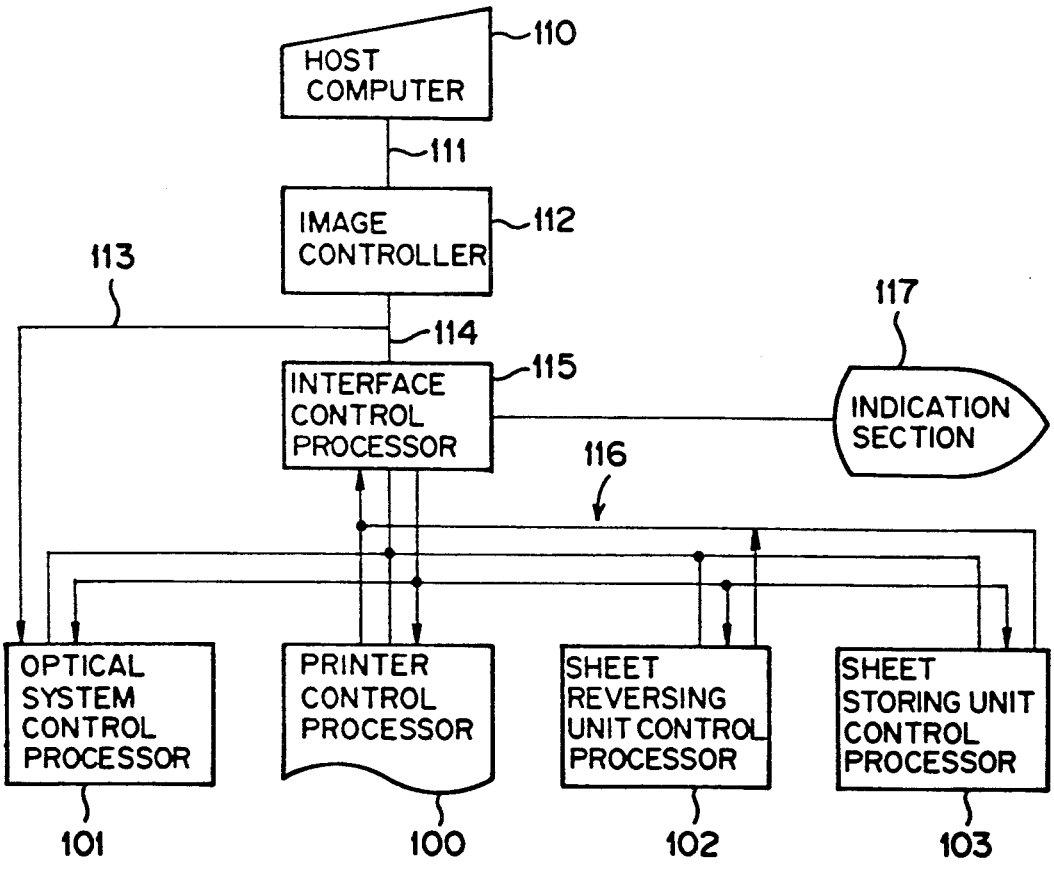
FIGS. 3 and 4 are block diagrams showing a control circuit.

FIG. 3 shows a control circuit for the whole system.

A control processor 100 controls the printer body 1. A control processor 101 controls the laser beam optical system 2. A control processor 102 controls the sheet reversing unit 50. A control processor 103 controls the sheet storing unit 60. Information to be printed out is transmitted from a host computer 110 to an image controller 112 via a host interface 111. The image controller 112 sends information to be printed out to the optical system control processor 101 via a video line 113, and sends information on printing modes, etc. to an interface control processor 115 via a control line 114. The interface control processor 115 corresponds with the processors 100, 101, 102 and 103 via a serial interface 116. The interface control processor 115 further controls an indication section 117 of an operation panel of the printer body 1. The indication section 117 indicates the states of the processors 100 through 103 by order of the interface control processor 115.

Figure 4:
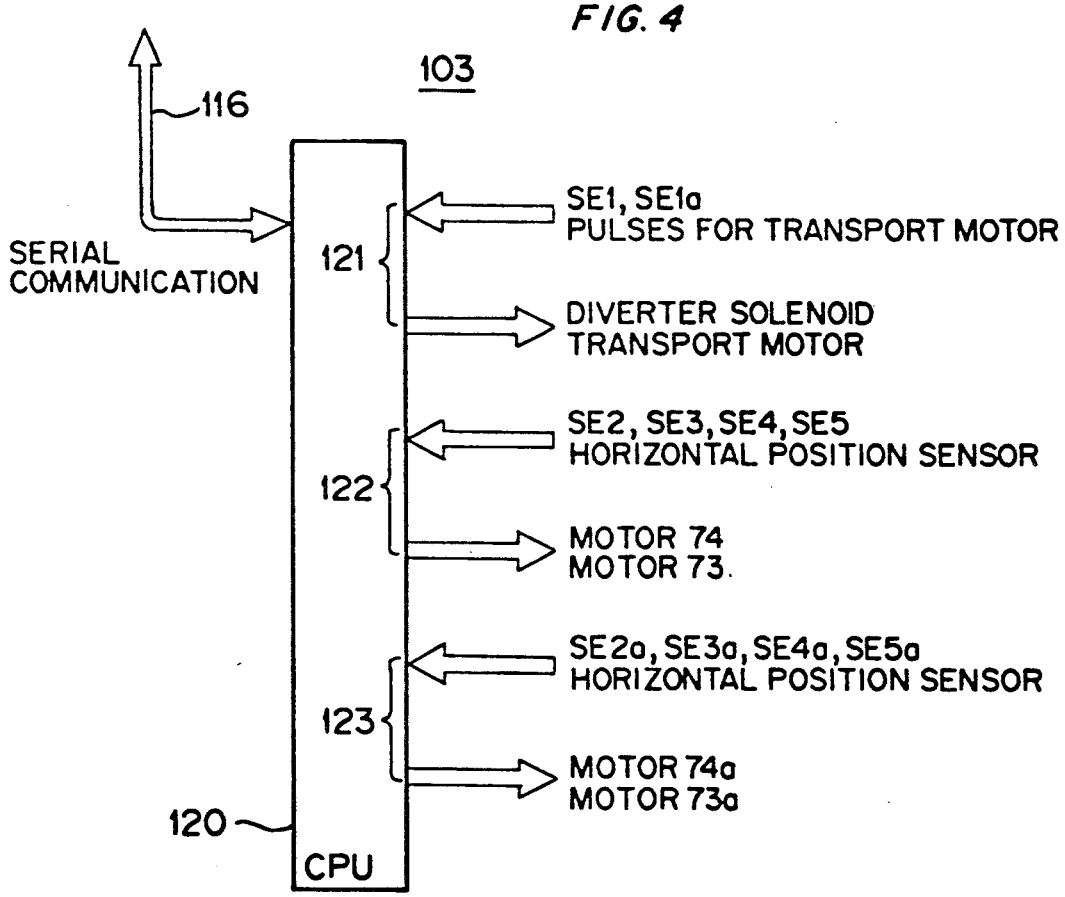

FIG. 4 shows the constitution of the sheet storing unit control processor 103.

The main element of the processor 103 is a CPU 120. An input/output block 121 of the CPU 120 is connected with the sheet sensors 8E1 and 8E1*a* provided in the sheet paths leading to the trays 70 and 70*a*, a pulse oscillator oi a transport motor, the solenoid for driving the diverter 67 and a transport motor drive circuit. Another input/output block 122 is connected with the sensors SE2, SE3, SE4 and SE5 provided in the upper tray unit, a sensor for detecting the horizontal position of the tray 70, and the motors 73 and 74. The other input/output block 123 is connected with the sensors and motors provided in the lower tray unit likewise.

A procedure performed by the control processor 103 to control the sheet storing unit 60 is hereinafter described referring to FIGS. 5 through 9.

Figure 5:
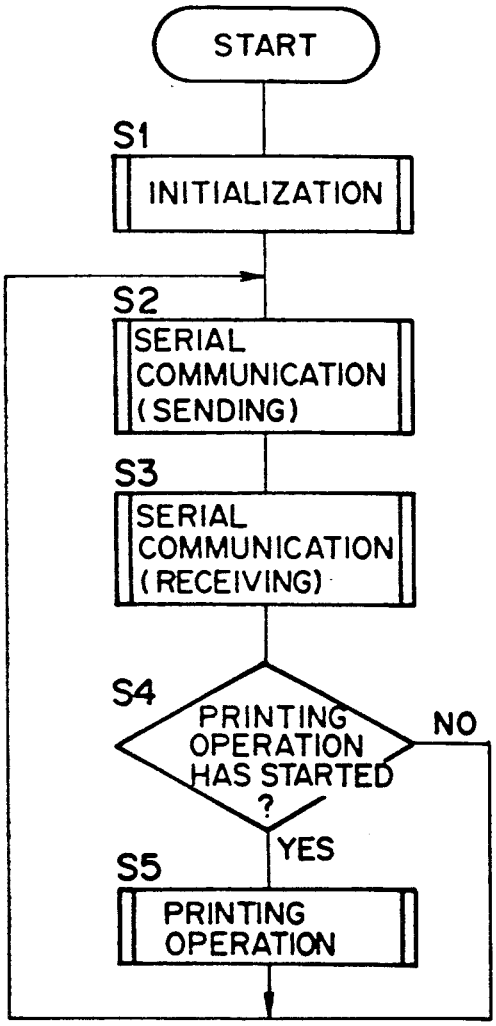
FIG. 5 is a flowchart showing a main routine of a CPU controlling the sheet storing unit.

FIG. 5 shows a main routine of the CPU 120. When power is supplied and a program starts, first at step S1 initialization is performed to reset the flags, timers and counters. At steps S2 and S3, the CPU 120 communicates with the other processors 100, 101, 102 and 115 via the serial interface 116. When it is judged at step S4 that sequence control for a printing operation has started, a subroutine for a printing operation is carried out at step 85.

Figure 6:
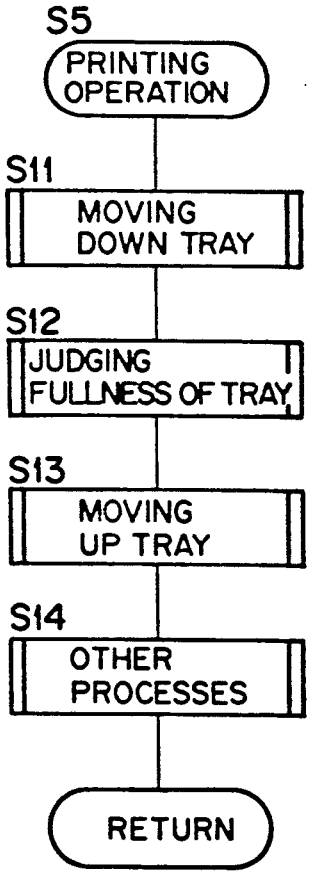
FIG. 6 is a flowchart showing a subroutine for printing.

FIG. 6 shows the printing subroutine to be carried out at step 35. In this subroutine, the downward movement of the tray 70 is controlled at step S11, fullness of the tray 70 is judged at step S12, the upward movement of the tray 70 is controlled at step S13, and the other processes such as transport of sheets, detection o±sheet jamming, etc. are controlled at step 14.

Figure 7:
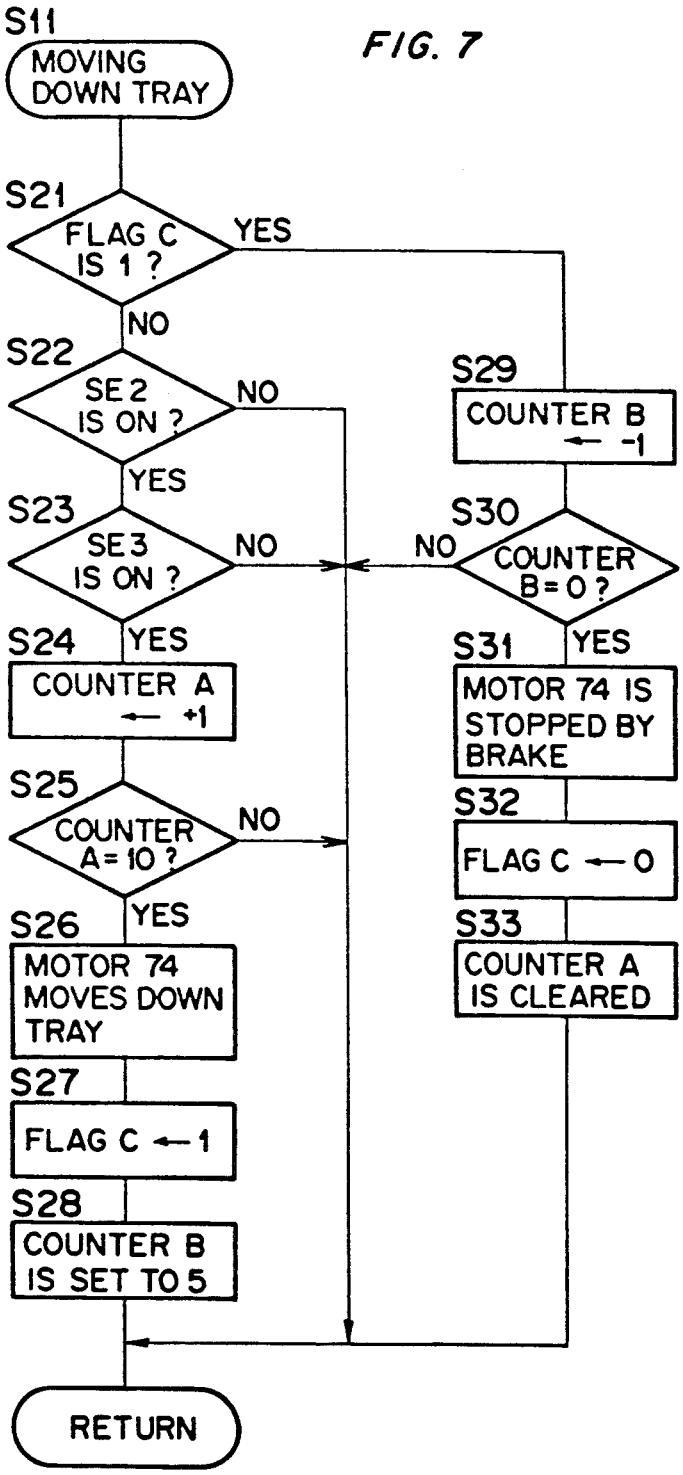
FIG. 7 is a flowchart showing a subroutine for moving down a tray.

FIG. 7 shows a subroutine for controlling the downward movement of the tray 70, which is carried out at step S11.

First, a flag C is checked at step S21. The flag C is "1" while the tray 70 is moving down. When the flap C is judged at step S21 not to be "1", which means that the tray 70 is not moving down, the sensor SE2 is checked at step S22 so as to judge the presence of a sheet on the tray 70. When the sensor SE2 is off, which means that there are no sheets on the tray 70, this subroutine is terminated immediately. When the sensor SE2 is on, the processing goes to step S23 so as to check the upper limit sensor SE3. When the sensor SE3 is on, which means that the top surface oi a sheet stack on the tray 70 reaches the upper limit, a counter A gains an increment at step S24. This routine is repeated until the counter A becomes "10" in this embodiment, a cycle of the main routine takes 0.1 second. Therefore one second after the sensor SE3 is turned on, the counter A becomes "10" at step S25, in which state the processing goes to step 826. At step S26 the vertical motor 74 is turned on so as to move down the tray 70.

If the tray 70 was controlled to move down immediately in response to a turning-on of the sensor SE3, the elastic blades of the paddle wheels 78 could not contact with the topmost sheet of the sheet stack, and the paddle wheels 78 could not provide the sheet with force required for keeping the sheet stack in alignment. In this embodiment, the tray 70 starts moving down with a slight time lag. Some sheets are fed from the printer body 1 onto the tray 70 during the time lag, and the paddle wheels 78 contact with these sheets certainly, thereby eliminating the fear that sheets on the tray 70 may be out of alignment.

When the vertical motor 74 is turned on, the flag C and a counter B are set to "1" and "5" at steps S27 and S28 respectively. The counter B is to determine a travel of the tray 70. In the next cycle of the routine, the processing jumps from step S21 to step S29 because the flag C is "1". At step S29 the counter B is reduced by one. This routine is repeated until the counter B becomes "0", which takes 0.5 seconds. When the counter B is judged to be "0" at step S30, the motor 74 is stopped by a brake at step S31. Thus, the motor 74 is controlled to rotate for 0.5 seconds. The flag C is reset to "0" at step S32, and the counter A is cleared at step S33.

Figure 8:
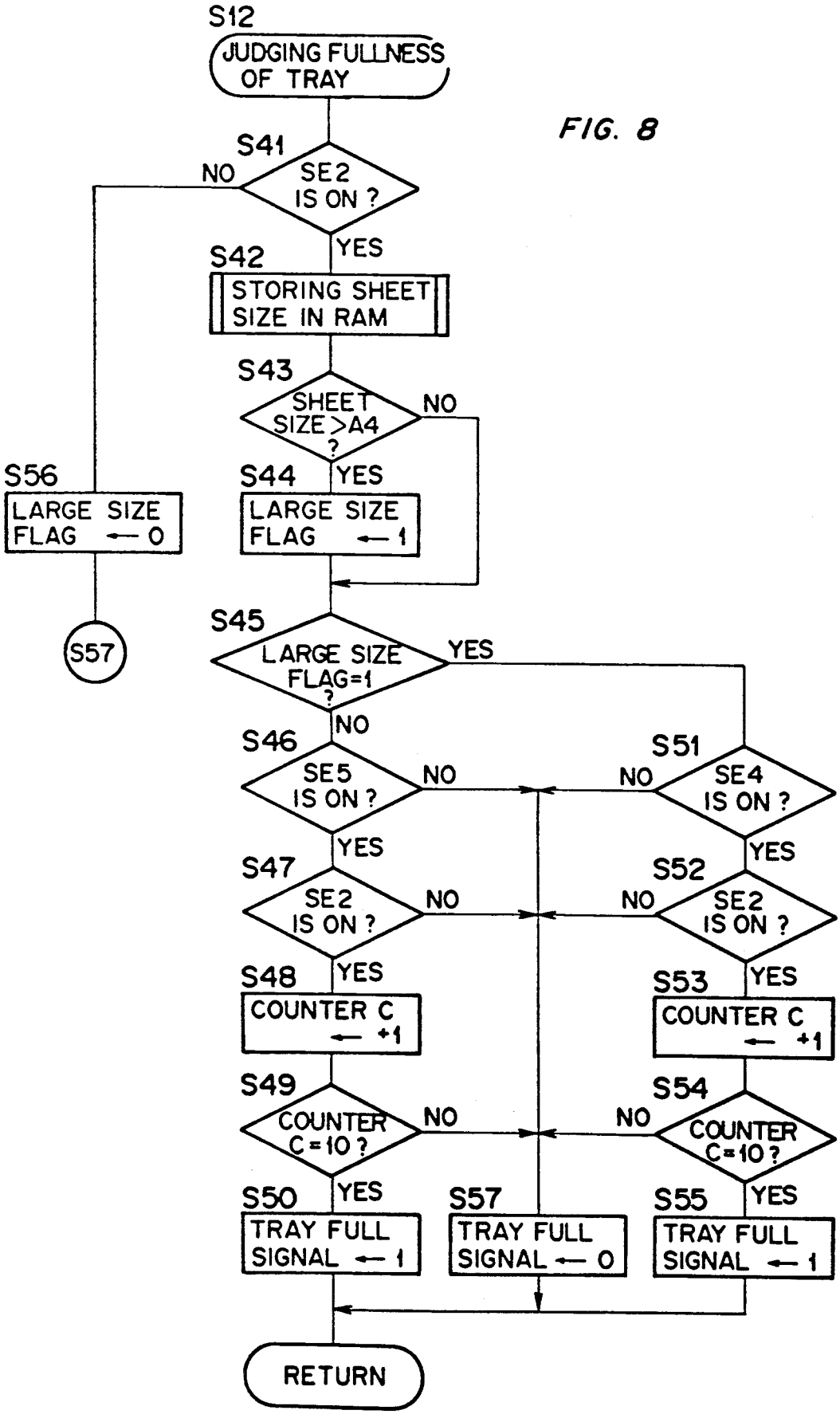
FIG. 8 is a flowchart showing a subroutine for judging fullness of the tray.

FIG. 8 shows the subroutine for judging fullness of the tray 70, which is carried out at step S12.

First, the sensor SE2 is checked at step S41 so as to judge the presence of a sheet on the tray 70. When the sensor SE2 is on, the size of the sheet is stored in an RAM at step S42. Information on the sheet size is transmitted from the processor 100 for controlling the printer body 1 to the CPU 120. It is judged at step S43 whether the sheet size is larger than A4. When the sheet size is larger than A4, a large size flag is set to "1" at step S44.

The large size flag is checked at step S45. When the flag is "0", the processing goes to step S46 where the sensor SE5 is checked. When the flag is "1", the processing goes to step S51 where the sensor SE4 is checked. When sheets on the tray 70 are small and light (A4 size or smaller than A4 size), fullness of the tray 70 is judged by the sensor SE5 which is disposed under the sensor SE4. On the other hand, the sheets are large and heavy (B4 size), fullness of the tray 70 is judged by the sensor SE4.

When the tray 70 is moved down to a detection point of the sensor SE5 or SE4 and the sensor SE5 or SE4 is judged to be on at step S46 or S51, the sensor SE2 is checked again at step S47 or S52 to confirm the presence of sheets on the tray 70. Then, a counter C gains an increment at step S48 or S53. This routine is repeated until the counter C becomes "10". When the counter C is judged to be "10" at step S49 or S54, a tray full signal is set to "1" at step S50 or S55. The tray full signal is transmitted to the processor 100 for controlling the printer body 1 so as to stop the printing operation. The tray full signal is kept off as long as the sensor SE5 or SE4 is off Even when the sensor SE5 or SE4 is on, if the sensor SE2 is judged to be off at step S47 or S52, the tray full signal is kept off. Further, the tray full signal is not set to "1" until the counter C becomes "10". The counter C is cleared when the tray 70 is released from the fullness.

Thus, the tray full signal is set to "1" one second after the turning-on of the sensor SE4 or SE5. With this arrangement, the tray 70 can receive sheets to just the limit of its capacity. When the tray 70 comes down to the detection point of the sensor SE4 or SE5, there is still a room on the tray 70. Therefore, the tray 70 is allowed to receive some more sheets during the one second.

The large size flag is reset to "0" at the initialization step and when the sensor SE2 is judged to be off at step S41, that is, when the tray 70 is emptied of sheets. Once the large size flag is set to "1" in response to a sheet size signal sent from the printer body 1, fullness of the tray 70 is judged in the condition unless all the sheets are discharged from the tray 70. As long as the tray 70 is at or under the detection point of the sensor SE4, the sensor SE4 keeps on. While the sensor SE4 is on, if the sheet feeding cassette or unit is reselected so as to feed sheets larger than A4, the large size flag is set to "1" at step S44, and the sensor SE4 is judged to be on at step S51. One second after, the tray full signal is set to "1".

By controlling the sheet storing unit 60 under the procedure above, the tray 70 can be moved down farther when loaded with sheets of a small size than when loaded with sheets of a large size. The tray 70 can receive the same weight of sheets regardless of the size of sheets, thereby making it possible to make full use of the sheet storing unit 60.

Figure 9:
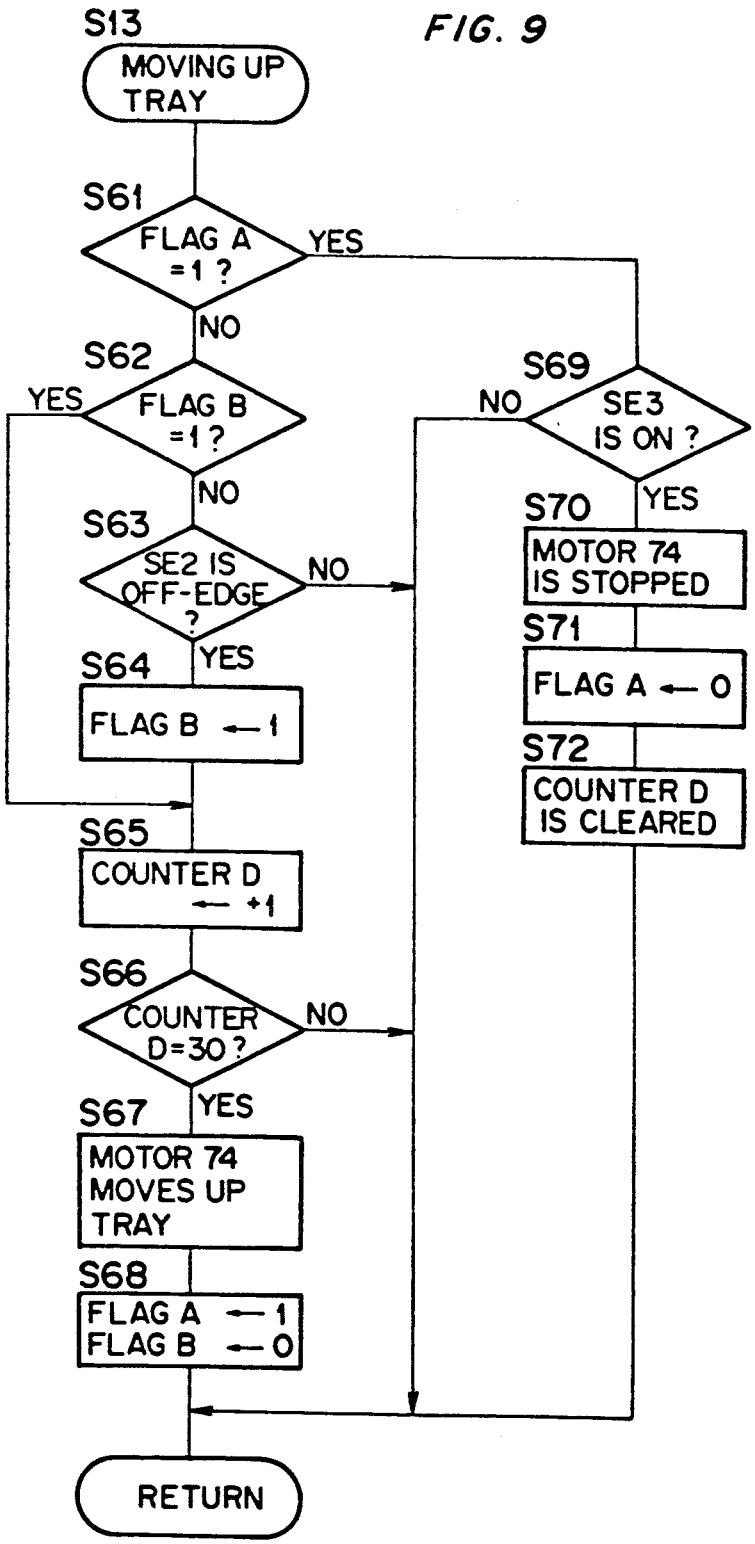
FIG. 9 is a flowchart showing a subroutine for moving up the tray.

FIG. 9 shows the subroutine for controlling the upward movement of the tray 70, which is performed at step S13. This subroutine is to move the tray 70 up to the initial position when the tray 70 is emptied of sheets.

Flags A and B are checked at steps S61 and S62 respectively. The flag A is "1" while the tray 70 is moving up. The flag B is kept "1" after the tray 70 gets emptied of sheets until the tray 70 starts moving up. When both of the flags A and B are "0", it is judged at step S63 whether the sensor SE2 is off-edge. When the sensor SE2 is off-edge, which means that the lowermost sheet on the tray 70 has been separated from the tray 70' the flag B is set to "1" at step S64. Then. a counter D gains an increment at step S65. In the next cycle of the routine, the flag B is judged to be "1" at step S62, and the processing goes to step S65 immediately. This routine is repeated until the counter D becomes "30". When the counter D is judged to be "30" at step S66, the vertical motor 74 is rotated at step S67 so as to move up the tray 70. Subsequently at step S68 the flag A is set to "1", and the flag B is reset to "0".

Since the tray 70 started moving up, the flag A is judged to be "1" at step S61 in the next cycle of the routine, and the processing goes to step S69 where the sensor SE3 is checked. When the sensor SE3 is on, which means that the tray 70 has moved up enough to reach the actuator 76, the motor 74 is stopped at step S70. Then, the flag A is reset to "0" at step S71, and the counter D is cleared at step 872.

In this embodiment, the tray 70 does not start moving up until the counter D becomes "30". That is, after the judgment of an off-edge of the sensor SE2, the tray 70 waits three seconds before starting an upward movement. When the operator lifts up the sheets on the tray 70 so as to discharge the sheets therefrom, the sensor SE2 is judged offedge at step S63. Without the counter D, in this situation the processing would proceed to step S69 immediately, and the sensor SE3 might be judged to be on. In this case, the vertical motor 74 would be turned off at step S70. Consequently, when the operator finishes discharging the sheets from the tray 70, the tray 70 would not move up. The counter D is provided so as to avoid such trouble. Since it generally takes one to two seconds for an operator to discharge sheets from the tray 70, this subroutine is so made that the tray 70 waits for three seconds before starting an upward movement.

Although the present invention has been described in connection with the preferred embodiment above, it is to be noted that various changes and modifications are apparent to those who are skilled in the art. Such changes and modifications are to be understood as being in the scope of the present invention as defined by the appended claims.

For example, the control procedure can be so made that when the tray 70 becomes full of sheets, the indication section 117 of the operation panel indicates fullness of the tray 70 as well as the printer body 1 stops the printing operation. In this embodiment sheet sizes are categorized into two kinds so as to determine the height limit of a sheet stack on the tray 70, but the sheet sizes can be categorized into three or more kinds.

Although in this embodiment the sheet size is judged from a signal sent from the printer body 1, the sheet storing unit 60 can be so made to detect the sheet size inside the unit 60.

What is claimed is:

1. A sheet storing apparatus comprising: means for stacking sheets transported thereto;

drive means for moving up and down the sheet stacking means;

means for detecting a sheet on the sheet stacking means;

means for detecting the surface of the sheet stacking means on which sheets are to be stacked or the top surface of a sheet stack on the sheet stacking means being at a specified position;

control means for controlling the drive means to start moving up the sheet stacking means a specified time after the sheet detecting means detects no sheets and to stop the upward movement of the sheet stacking means when the top surface detecting means generates a detection signal;

wherein said specified time is selected to provide an operator adequate time to remove sheets from the sheet stacking means.

2. A sheet storing apparatus as claimed in claim 1, wherein the control means includes means for counting the specified time.

3. A sheet storing apparatus as claimed in claim 1, wherein said specified time is at least one second.

4. A sheet storing apparatus as claimed in claim 1, further comprising a timer means for counting an elapsed time.

5. A sheet storing apparatus as claimed in claim 4, wherein the timer means starts counting when the detection signal is generated.

6. A sheet storing apparatus comprising:

means for stacking sheets transported thereto;

means for aligning sheets transported to the sheet stacking means;

drive means for moving up and down the sheet stacking means;

means for detecting a sheet on the sheet stacking means;

means for detecting the surface of the sheet stacking means on which sheets are to be stacked or the top surface of a sheet stack on the sheet stacking means being at a specified position; and control means for controlling the drive means to start moving down the sheet stacking means a specified time after the top surface detecting means generates a detection signal in a situation that the sheet detecting means detects a sheet;

wherein said specified time is selected to provide adequate time for said aligning means to align a sheet being transported to said stacking means.

7. A sheet storing apparatus as claimed in claim 6, wherein the sheet aligning means finishes aligning the sheets within the specified time.

8. A sheet storing apparatus as claimed in claim 7, wherein the control means controls the drive means to move down the sheet stacking means by a small amount enough that a sheet transported to the sheet stacking means immediately after its downward movement can be under the force at the aligning means.

9. A sheet storing apparatus as claimed in claim 8, wherein the sheet aligning means is disposed in the neighborhood of an entrance through which sheets are transported onto the sheet stacking means.

10. A sheet storing apparatus as claimed in claim 9, wherein the sheet aligning means comprises:

a member for regulating an edge of a sheet transported onto the sheet stacking means; and a member disposed in the neighborhood of the entrance for urging the sheet toward the regulating member.

11. A sheet storing apparatus as claimed in claim 10, wherein the urging member is a paddle wheel consisting of a shaft and elastic blades radiating from the shaft, and the paddle wheel is disposed in a position where the blades can contact with the upper surface of a sheet transported onto the sheet stacking means, and is rotated in a direction where the paddle wheel urges the sheet toward the regulating member.

12. A sheet storing apparatus as claimed in claim 6, wherein the control means includes means for counting the specific time.

13. A sheet storing apparatus as claimed in claim 6, wherein said specified time is at least one second.

14. A sheet storing apparatus as claimed in claim 6, further comprising a timer means for counting an elapsed time.

15. A sheet storing apparatus as claimed in claim 14, wherein the timer means starts counting when the detecting signal is generated.

16. A sheet storing apparatus comprising:

means for stacking sheets transported thereto;

drive means for moving the sheet stacking means up and down;

means for detecting a sheet on the sheet stacking means;

means for detecting the surface of the sheet stacking means on which sheets are to be stacked or the top surface of a sheet stack on the sheet stacking means being at a specified position;

control means for controlling the drive means to start moving up the sheet stacking means a specified time after the sheet detecting means detects no sheets and to stop the upward movement of the sheet stacking means when the top surface detecting means generates a detection signal; and timer means for counting the specified time after the sheet detecting means detects no sheets.

17. A sheet storing apparatus as claimed in claim 16, wherein said specified time is at least one second.

18. A sheet storing apparatus comprising:

means for stacking sheets transported thereto;

means for aligning sheets transported to the sheet stacking means;

drive means for moving the seat stacking means up and down;

means for detecting a sheet on the sheet stacking means;

means for detecting the surface of the sheet stacking means on which sheets are to be stacked or the top surface of a sheet stack on the sheet stacking means being at a specified position;

control means for controlling the drive means to start moving down the sheet stacking means a specified time after the top surface detecting means generates a detection signal in a situation that the sheet detecting means detects a sheet; and timer means for counting the specified time after the top surface detecting means generates the detecting signal.

19. A sheet storing apparatus as claimed in claim 18, wherein said specified time is at least one second.

20. A method of stacking sheets, comprising the steps of:

stacking sheets on a top surface of a sheet stacking platform;

monitoring the sheet stacking platform to detect when all of the sheets have been removed from the sheet stacking platform;

starting a timer when its is detected that the sheets have been removed from the sheet stacking platform;

moving the sheet stacking platform upward, starting at a time when the timer has counted a specified period of time after the sheet removal has been detected; and stopping the upward movement of the sheet stacking platform when the top surface of the sheet stacking platform reaches a predetermined position.

21. A method of stacking sheets, comprising the steps of:

transporting sheets onto a sheet stacking platform;

aligning each sheet as it is transported to the sheet stacking platform;

monitoring the height of the surface of a top sheet stacked on the sheet stacking platform;

starting a timer when it is determined that the surface is at a predetermined position; and moving the sheet stacking platform downward after the timer has counted a predetermined period of time.

* * * * *